US006388624B1

(12) United States Patent
Kazumi et al.

(10) Patent No.: US 6,388,624 B1
(45) Date of Patent: May 14, 2002

(54) PARALLEL-PLANAR PLASMA PROCESSING APPARATUS

(75) Inventors: Hideyuki Kazumi, Hitachinaka; Hironobu Kawahara, Kudamatsu, both of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/796,619

(22) Filed: Mar. 2, 2001

(30) Foreign Application Priority Data

Aug. 25, 2000 (JP) ..... 12-260849

(51) Int. Cl.[7] ..... H01Q 1/26

(52) U.S. Cl. ..... 343/701; 156/345; 118/723 MA; 438/710

(58) Field of Search ..... 343/701; 156/345; 118/723 MA, 723 MR; 438/710, 729

(56) References Cited

U.S. PATENT DOCUMENTS 5,824,607 A * 10/1998 Trow et al. ..... 438/732
6,171,438 B1 * 1/2001 Masuda et al. ..... 156/345
6,180,019 B1 * 1/2001 Kazumi et al. ..... 216/78
6,251,792 B1 * 6/2001 Collins et al. ..... 438/710

FOREIGN PATENT DOCUMENTS

| | | |
|---|---|---|
| JP | 8-288096 | 11/1996 |
| JP | 9-63793 | 3/1997 |
| JP | 10-134995 | 5/1998 |
| JP | 11-354502 | 12/1999 |

* cited by examiner

*Primary Examiner*—Tho G. Phan
(74) *Attorney, Agent, or Firm*—Antonelli, Terry, Stout & Kraus, LLP

(57) ABSTRACT

In a method of generating plasma by using a high frequency in VHF or UHF band and a magnetic field, a plasma processing apparatus has an antenna and an emitting port which are adapted to supply the high frequency in UHF or VHF band to a processing chamber and a magnetic field forming unit for forming a magnetic field in the processing chamber, wherein the ratio between the radius of the antenna and the effective length of the emitting port is 0.4 or more and 1.5 or less, whereby plasma of high density and high uniformity can be generated in a wide parameter region.

8 Claims, 8 Drawing Sheets

SCHEMATIC DIAGRAM ILLUSTRATIVE OF UHF-ECR (FREQUENCY : 450MHz, EMITTING PORT (DIELECTRIC) : QUARTZ

UHF ELECTRIC FIELD INTENSITY

ELECTRIC FILED INTENSITY DISTRIBUTION DIRECTLY BELOW ANTENNA

PARALLEL-PLANAR PLASMA PROCESSING APPARATUS

CROSS-REFERENCE TO RELATED APPLICATIONS

This application is related to application Ser. No. 09/793,443 filed on Feb. 27, 2001, which claims the right of priority based on Japanese Patent Application No. 2000-081735 filed on Mar. 17, 2000, and which is assigned to the same assignee as the present application. The contents of application Ser. No. 09/793,443 are incorporated herein by reference in their entirety.

BACKGROUND OF THE INVENTION

The present invention relates to a plasma processing apparatus for processing an object to be processed (process object) by using plasma.

In processing a process object especially an insulating film by utilizing plasma, a parallel-planar plasma processing apparatus, for example, has hitherto been used in which different two radio frequencies (RF's) are applied to opposing electrodes (prior art 1). A plasma processing apparatus having a permanent magnet disposed in ring-form arrangement on the back of a RF electrode is disclosed in, for example, JP-A-8-288096 (prior art 2). A plasma processing apparatus, in which a planar antenna member is so disposed as to oppose an electrode carrying an object to be processed, the antenna member being supplied with a $\mu$ wave and a slit opening is formed in a front surface of the planar antenna, is described in, for example, JP-A-9-63793 (prior art 3). An etching apparatus using a high frequency in UHF band, in which an earth structure on the top of an antenna is concave, is disclosed in, for example, JP-A-11-354502 (prior art 4). Further, a parallel-planar UHF plasma apparatus in which a high frequency in UHF band is supplied to a disk-shaped antenna by a coaxial cable and the antenna diameter is set to a predetermined value $n/2\cdot\lambda$ (n: integer) is disclosed in, for example, JP-A-10-134995 (prior art 5).

SUMMARY OF THE INVENTION

Prior art 1 lacks plasma distribution control means and hence, when the kind of gas and the pressure are changed, distribution of radical compositions and that of reaction products change, making it sometimes difficult to make the processing distribution uniform. In addition, plasma is difficult to increase in density and the processing speed (etching rate) is slow.

In prior art 2, the permanent magnet is used and as a result, a magnetic field is formed locally at a site nearly limited to the size of the permanent magnet. When the trapping effect due to the magnetic field is desired to be increased, the intensity of the magnetic field increases near the magnet and the plasma density becomes high at that portion. Further, a bias is applied to the RF electrode to draw ions and as a result, sputtering takes place locally, raising a problem that local wear of the electrode is caused to increase foreign matters and decrease the reliability of the apparatus. For the magnetic field formed at that portion, compatibility between local improvement and distribution controllability is difficult to achieve.

In prior art 3, the slit is formed in the antenna and the length of the slit is set to about ½ to 1/10 of $\lambda$ ($\lambda$:a wavelength of $\mu$ wave in the tube) to adjust the distribution but it is difficult to adjust the radiation of $\lambda$ wave and the electric field distribution.

Prior art 4 pertains to the earth structure on the top of an antenna for avoidance of concentration of electric field. Even if the earth structure is made to be concave, difficulties still remain in making the electric field distribution per se uniform and adjustment of the distribution is difficult to achieve when gas, pressure or power is changed.

In prior art 5, since the antenna center corresponds to the maximum amplitude of electric field and the antenna edge corresponds to the node of electric field, the electric field distribution directly below the antenna always becomes convex. Consequently, it is difficult to make plasma uniform.

Accordingly, an object of the present invention is provide, in a method of generating plasma by using a high frequency in VHF or UHF band and a magnetic field, a plasma processing apparatus which can realize the generation of plasma of high density and high uniformity in a wide parameter region.

To accomplish the above object, according to one aspect of the invention, a plasma processing apparatus comprises a vacuum vessel, a processing chamber arranged in the vacuum vessel and supplied with gas, a support electrode arranged in the processing chamber to support an object to be processed, high frequency admitting means including a disk-shaped antenna for supplying a high frequency in UHF or VHF band to the processing chamber and an emitting port arranged laterally of the antenna and formed of an insulating member, and magnetic field forming means for forming a magnetic field in the processing chamber, wherein in the high frequency admitting means, the ratio between the radius of the antenna and the effective length of the emitting port is 0.4 or more and 1.5 or less. The effective length d* of emitting port referred to herein is given by $d^*=(f/f_0)\,d/\in_r^{1/2}$ where the real size of the emitting port is d, the specific inductivity of the insulating member constituting the emitting port is $\in_r$, the frequency used is f and the reference frequency $f_0$ is 450 MHz.

Where the high frequency has a wavelength of $\lambda_0$ in vacuum, the radius of the antenna is preferably $\lambda_0/4$ or less. Preferably, a surface of the antenna opposing the processing chamber is made of Si, SiC or C. Preferably, part of the emitting port is closed with a metal plate to restrict the size of the emitting port approximately to a wafer diameter to be processed. Further, the antenna is formed with a slit opening (openings), a planar member made of Si, SiC or C is arranged on the surface of antenna adjoining plasma and the high frequency is supplied to the processing chamber through the planar member.

Other objects, features and advantages of the present invention will become apparent from the following description of the embodiments of the invention taken in conjunction with the accompanying drawings.

DETAILED DESCRIPTION OF THE EMBODIMENTS

Figure 1:
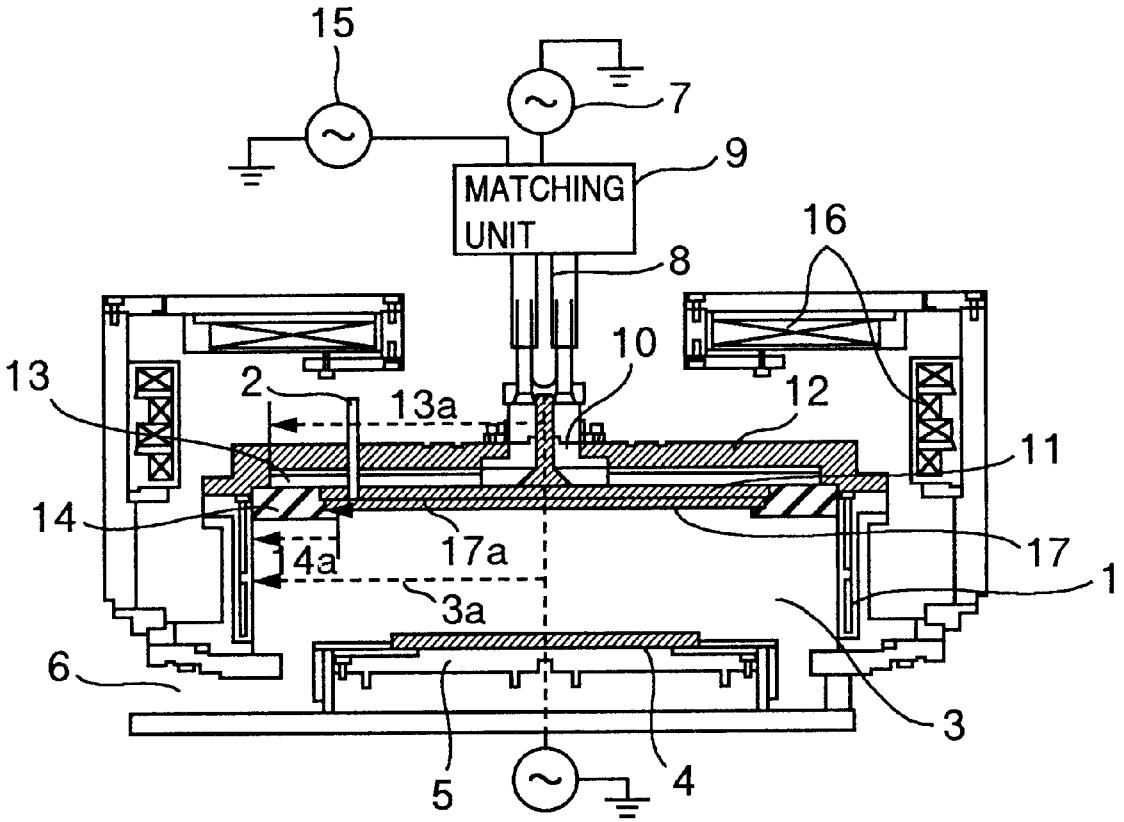
FIG. 1 is a sectional diagram showing a plasma processing apparatus according to a first embodiment of the invention.

With fine structuring and high degree of integration of ULSI devices accelerated, devices having a processed size of 0.18 $\mu$m will soon be put into mass production and devices having a processed size of 0.13 $\mu$m have also been developed. On the other hand, construction of 300 mm$\phi$ wafer line has been proceeded with and highly accurate etching techniques and technique conforming to large diameter have been demanded. Under the circumstances, when high selectivity for underlying layer and resist is desired to be obtained in oxide film etching, such troubles as "etch stop" causing an etching reaction to be stopped on the way and "RIE-lag" are liable to occur, making it more difficult to establish compatibility between high aspect vertical process shaping and high selectivity. In addition, to meet speedup of device operation, films of low dielectric constant have been introduced to thereby increase the kinds of films to be processed.

On the other hand, fine structuring and high-density integration of ULSI devices have been accelerated and correspondingly, preciseness of etching techniques and conformity to large diameter have been demanded. Then, in the insulating film etching for processing oxide films and low dielectric constant insulating films, there is a growing need for coping with not only sophisticated device structures and fine structuring of the processing width but also a variety of kinds of processing films, so that high selectivity and vertical process shaping for resist and $Si_3N_4$have been demanded. But, when trying to obtain high selectivity for underlying layer and resist, "etch stop" in which the etching reaction is stopped on the way or "RIE-lag" tend to occur and establishment of compatibility between high aspect vertical process shaping and high selectivity becomes difficult more and more. In the insulating film etching, a fluorocarbon gas containing carbon and fluorine is used and an etching reaction is caused to proceed by irradiating ions on a deposited film of fluorocarbon radical (CxCy) decomposed by plasma. The film thickness or composition of the fluorocarbon film deposited on the oxide film, resist or $Si_3N_4$ differs case by case and the selectivity develops. It is considered that the higher the density ratio CxFy/F between fluorocarbon radical and F radical, the higher the obtainable selectivity becomes. On the other hand, as the amount of CxCy or the ratio of carbon increases, the etching reaction sometimes stops. The density of plasma and electron temperature as well as chemical reactions on the chamber wall and recycling dominate the composition of fluorocarbon radical. In addition, reaction products and their dissociative products prevent the etching. Therefore, in the oxide film etching, the density and temperature of plasma dominating the radicals and the dissociation of reaction products are sometimes controlled and for uniform processing of an object of large size, distribution of the plasma density and temperature must be controlled. In addition, for realization of high throughput, that is, high etching rate, it is indispensable to make the plasma density high. Mode for carrying out the invention will now be described using embodiments and reference examples.

Referring to FIG. 1, there is illustrated a first embodiment of the invention. A plasma processing apparatus comprises a vacuum vessel 1 having a processing chamber 3 to which gas is admitted through a gas inlet system 2 and a support stand (electrode) 5 for supporting an object 4 to be processed. The gas in the processing chamber is evacuated by an evacuation system 6. A high frequency 8 in UHF or VHF band generated in a UHF or VHF generating source 7 is supplied to a high frequency electrode 11 by way of matching unit 9 and transmission line 10. A dielectric 13 is filled between the high frequency electrode 11 and conductor wall 12 and the high frequency is admitted to the processing chamber 3 via an emitting port 14. Independently of the UHF or VHF generating source 7, a RF generating source 15 is provided to supply a high frequency in RF band to the same high frequency electrode 11. Magnetic field forming means 16 is disposed around the vacuum vessel 1 to form a magnetic field in the processing chamber 3. A disk-shaped antenna 17 is connected to the high frequency electrode. Specifically, in connection with the antenna and emitting port, the ratio between the antenna radius and the effective length of emitting port is 0.4 or more and 1.5 or less. The effective length d* of the emitting port referred to herein is defined by $d^*=(f/f_0)d/\epsilon_r^{1/2}$, where the used frequency is f, the used reference frequency $f_0$ is 450 MHz, the real size of the emitting port is d and the insulating member constituting the emitting port has a specific inductivity of $\epsilon_r$.

Figure 8A:
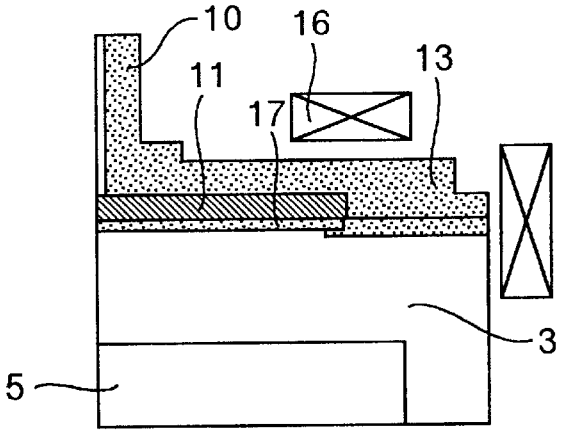
FIGS. 8A, 8B and 8C are diagrams useful to explain the operation of the first embodiment of the invention.
Figure 8B:
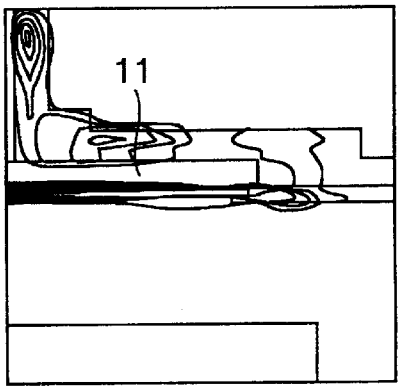
Figure 8C:
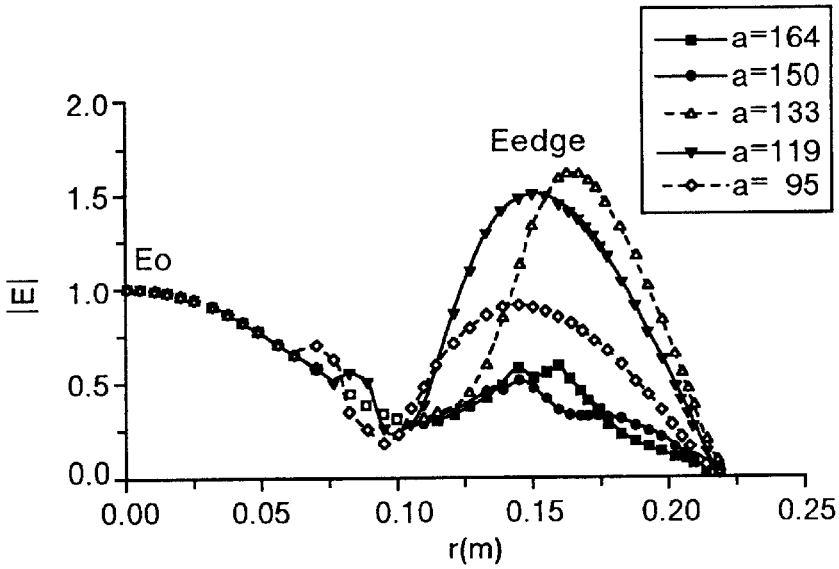
Figure 9:
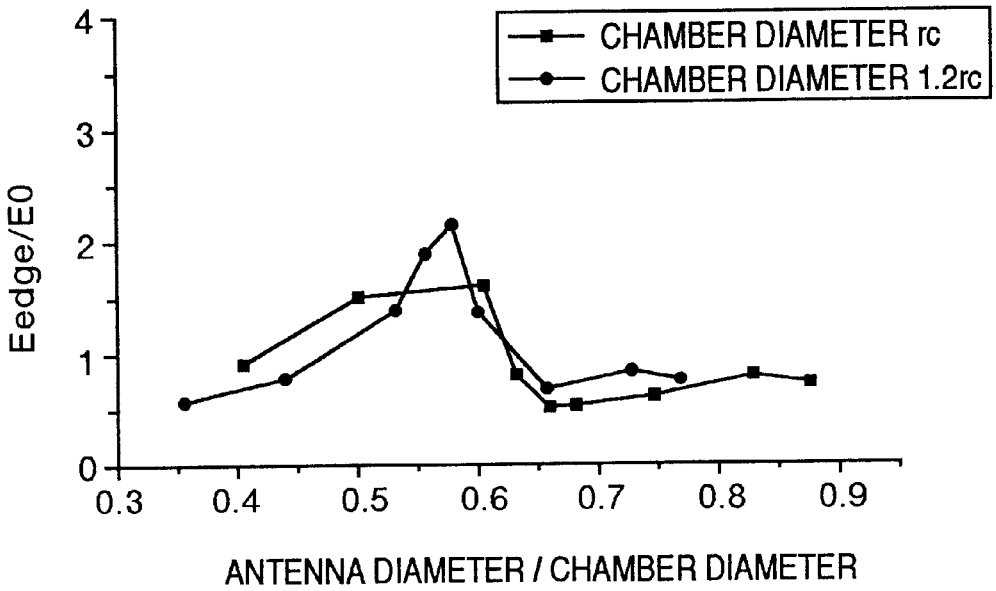
FIG. 9 is a graph for explaining operation and effect in the first embodiment of the invention.

By making reference to a system (using a UHF frequency of 450 MHz) shown in FIG. 8A, a description purporting that the ratio between radius 17*a* of the antenna and the effective length of emitting port 14 is a factor for determining the plasma distribution will be given. For example, results obtained when quartz (having a relative dielectric constant of 3.5) is used as a dielectric constituting the emitting port are shown below. An electric field in UHF band propagates in a sheath formed between plasma and the antenna. In case the antenna radius is 164 mm, electric field distribution as shown in FIG. 8B is obtained. Radial distribution of electric field directly below the antenna is depicted in FIG. 8C by using the antenna diameter as a parameter. Excepting for the antenna edge, the electric field distribution under the antenna has only z direction component and exhibit convex distribution (Bessel function) in which the central portion is high, a node takes place at a position equal to ¼ of a wavelength in waveguide (110 mm near the radius in FIG. 8A) and the distribution value is rendered to be zero at the antenna edge. On the other hand, when the antenna radius is 133 mm, the electric field distribution is the same as the aforementioned distribution until r=110 mm but has higher electric field intensity outside r=110 mm. The radial distribution of electric field changes depending on the antenna diameter as described above because the UHF high frequency supplied from the emitting port, on the one hand, propagates in the sheath so as to be absorbed by plasma but on the other hand, part of the UHF is reflected to return to the emitting port, is further reflected by metal members provided laterally of and on the back of the antenna and is again caused to propagate toward the sheath, thus repeating this cycle to form a standing wave. As a result, when the antenna size and the emitting port size change, the electric field distribution changes. In FIG. 8C, the electric field intensity in the center is $E_0$ and the maximum value of peripheral electric field intensity outside the antenna (its position changes with the antenna diameter) is $E_{edge}$. Given that the sum of the antenna diameter and the emitting port diameter is defined as chamber diameter $r_c$ and the antenna diameter is changed while keeping the chamber diameter constant, $E_{edge}/E_0$ changes as shown in FIG. 9, indicating that "1" is exceeded at a specified dimension. In this case, position $r_{peak}$ which the peripheral electric field intensity is maximized is $r_{peak} \approx 0.35*(r_c-a)+a$. Even when the chamber diameter is changed to 1.2 times the previous dimension, there is an antenna diameter at which $E_{edge}/E_0$ exceeds "1". When the above ratio $E_{edge}/E_0$ is indicated in terms of the antenna diameter/chamber diameter ratio, both the curves substantially overlap each other for different chamber diameters. This absolutely proves that the UHF high frequency propagates in the form of a standing wave that is determined by the antenna diameter and the emitting port diameter.

Figure 10:
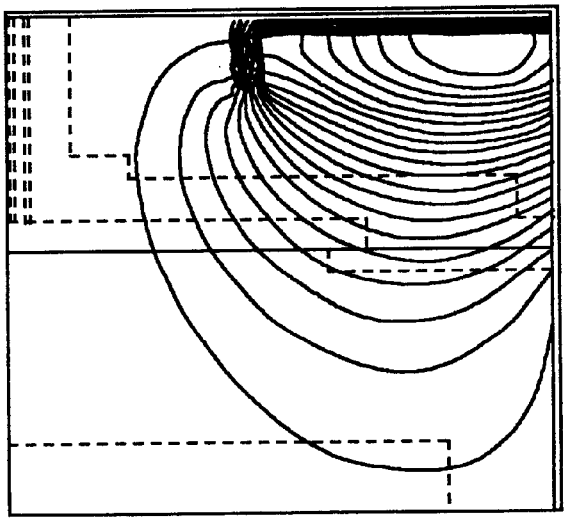
FIG. 10 is a diagram for explaining the effects in the first embodiment of the invention.
Figure 11A:
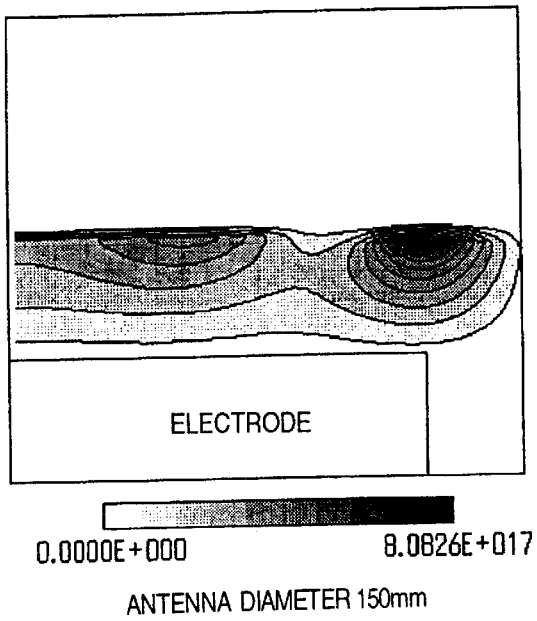
FIGS. 11A and 11B are diagrams showing operation and effect in the first and second embodiments of the invention.
Figure 11B:
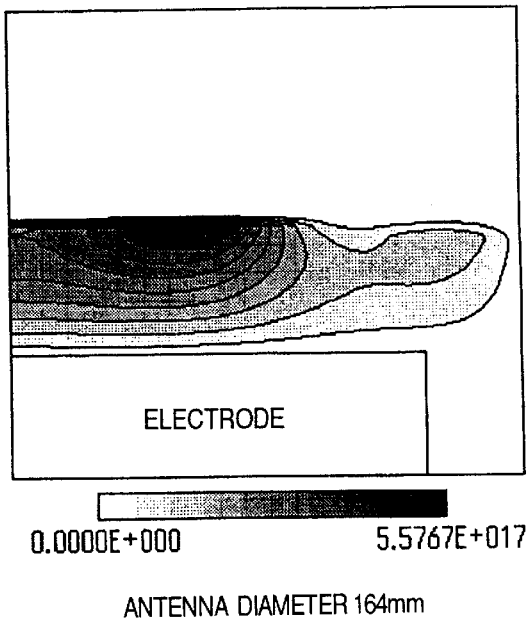

In case a diverging magnetic field (in which the magnetic field intensity is large in the center and decreases toward the periphery) as shown in FIG. 10 is used, the plasma density distribution as shown in FIGS. 11A and 11B is obtained which is relatively flat at a location where the ratio $E_{edge}/E_0$ is about 1. By specifying the antenna diameter and the emitting port diameter in this manner, the electric field distribution can be changed to make the diameter of plasma uniformly large.

Figure 12:
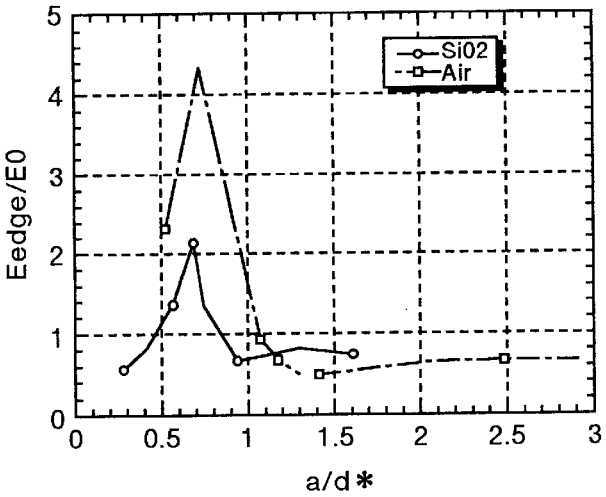
FIG. 12 is a graph for explaining the operation of the first embodiment of the invention.

Next, an instance will be described in which a dielectric using, as medium, air (relative dielectric constant of 1) trapped in thin quartz is used. The ratio $E_{edge}/E_0$ between peripheral and central electric fields is illustrated in relation to the ratio between antenna radius a and effective length d* of the emitting port as shown in FIG. 12. The relation in the case of using quartz as dielectric medium is also shown. A value of a/d* at which the electric field ratio $E_{edge}/E_o$ becomes about 1 or more is the same for the both cases, falling in a range of from 0.4 to 1.2. By making the ratio between the antenna radius and the effective length d* of the emitting port 0.4 or more and 1.5 or less in this manner, the electric field intensity at the periphery can be increased. Various forms of the emitting port are conceivable, provided that the real size d of the emitting port 14 is defined as a distance between its surface adjoining plasma and the metal wall.

Figure 2:
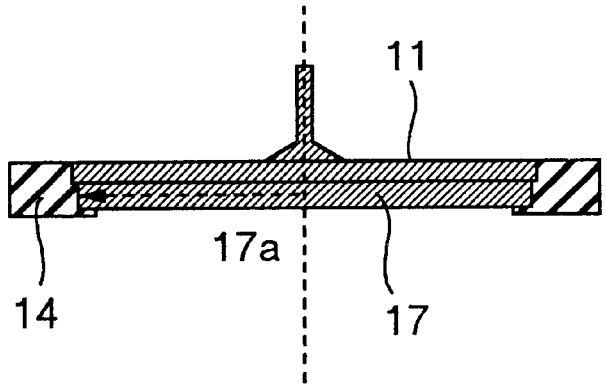
FIG. 2 is a sectional view of an electrode/antenna structure according to a second embodiment of the invention.

Referring to FIG. 2, a second embodiment of the invention will be described. In the present embodiment, the construction of the electrode and antenna used in the plasma processing apparatus is noticed. The present embodiment features that in the embodiment described in connection with FIG. 1, the radius 17*a* of the antenna is $\lambda_0/4$ or less, where $\lambda_0$ is a wavelength of the high frequency in vacuum. The high frequency in VHF or UHF band propagates through the sheath in the form of a standing wave. At a position of $\lambda/4$ (the high frequency is trapped in a closed space and the wavelength $\lambda$ is smaller than the wavelength $\lambda_0$ in vacuum) corresponding to a node of the wave, the electric field intensity is small and the plasma density decreases. Accordingly, the antenna diameter is made to be smaller than $\lambda_0$ to avoid the node of the electric field. Furthers as shown in FIG. 8C, the more the antenna diameter is restricted, the more the peak position of the peripheral electric field moves inward. Consequently, as will be seen from FIGS. 11A and 11B for the case where the frequency f is 450 MHz, the dielectric is made of quartz and the chamber diameter is $1.2r_c$, when an instance of the antenna radius being 164 mm is compared with an instance of the antenna radius being 150 mm, the plasma density is more increased at the periphery in the case of the 150 mm antenna radius than in the case of the 164 mm antenna radius to make the distribution uniform.

Figure 3:
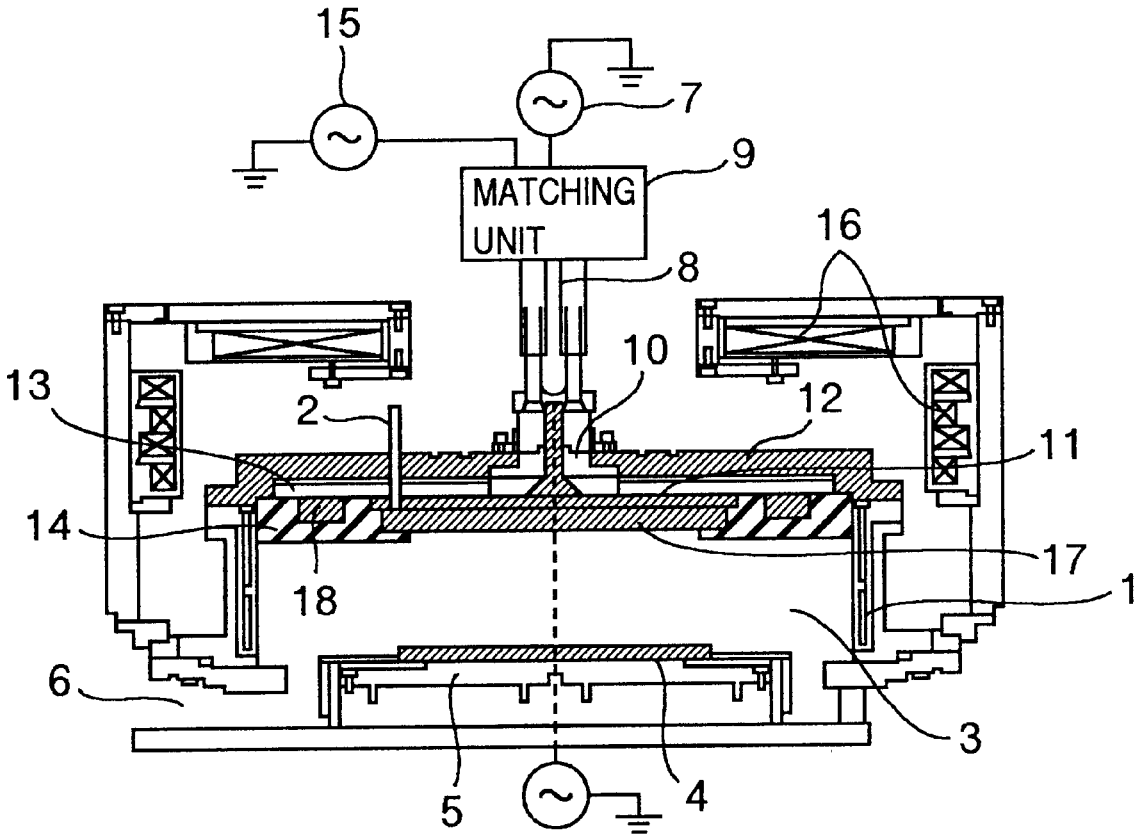
FIG. 3 is a sectional diagram showing a plasma processing apparatus according to a third embodiment of the invention.
Figure 13:
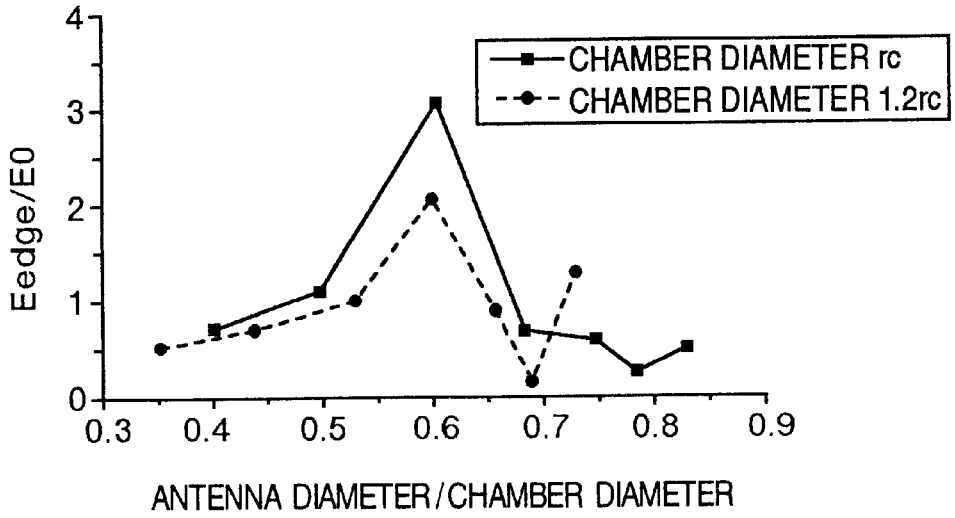
FIG. 13 is a graph for explaining operation and effect in the third embodiment of the invention.
Figure 14:
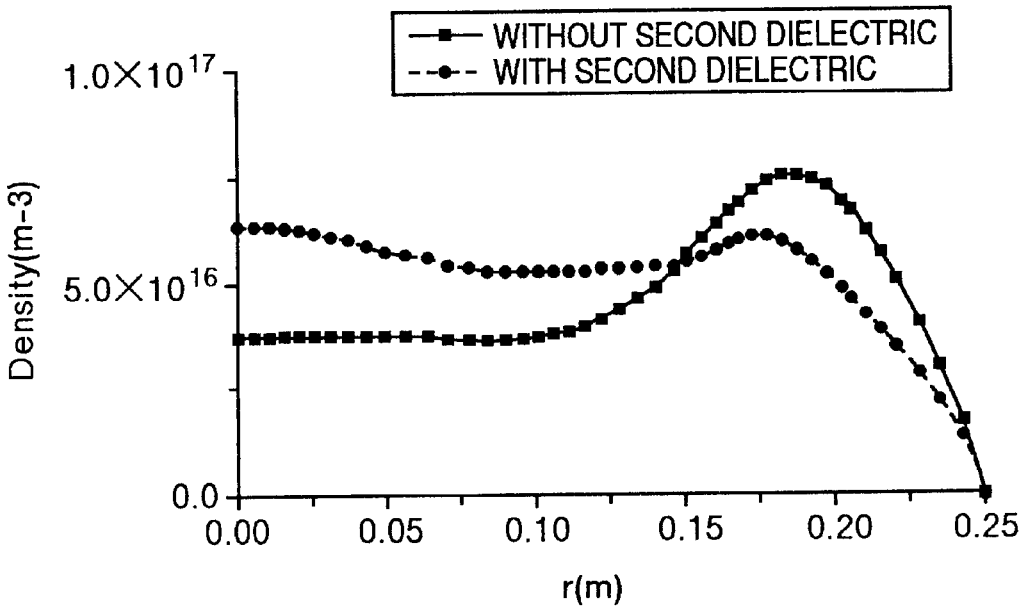
FIG. 14 is a graph for explaining operation and effect in the fifth embodiment of the invention.

Referring to FIG. 3, a third embodiment of the invention will be described. The present embodiment contemplates the construction of the electrode and antenna used in the plasma processing apparatus. The present embodiment features that in the embodiment described in connection with either FIG. 1 or FIG. 2, a ring-shaped conductor 18 is laid laterally of the antenna. The ring-shaped conductor is positioned at a location r near $r_{peak}$ where the peripheral electric field is maximized. Preferably, the distance between the ring and the antenna is $\frac{1}{8}\lambda_1$ or more and $\frac{3}{8}\lambda_1$ or less, where $\lambda_1$ is a wavelength of the high frequency at that location in the tube. The width of the ring 18 can be determined arbitrarily. The ring-shaped conductor 18 can intensify the electric field intensity under (on the side of the processing chamber) the location where the ring is arranged and therefore, in order to increase the electric field intensity, the thickness of the conductor is desired to be as thick as possible. In case the frequency f is 450 MHz and the dielectric of the emitting port is made of quartz, the distance between the ring and the antenna is preferably 8mm or more and 24 mm or less. Dependency of the electric field intensity on the antenna diameter/chamber diameter when the ring width is set to 15 mm is graphically illustrated in FIG. 13. It will be seen that values of the ratio $E_{edge}/Eo$ in the absence of the ring shown in FIG. 9 are increased in respect of the individual antenna diameters.

Figure 4:
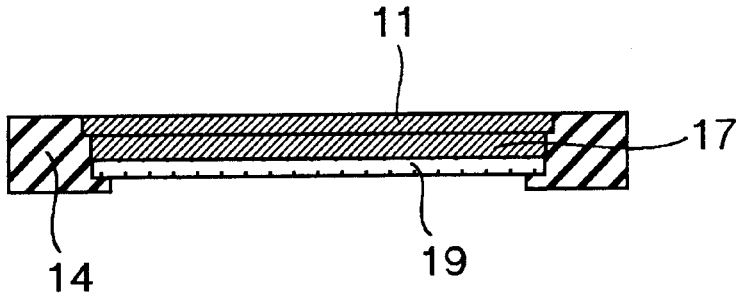
FIG. 4 is a sectional view of an electrode/antenna structure according to a fourth embodiment of the invention.

Referring to FIG. 4, a fourth embodiment of the invention will be described. The present embodiment contemplates the construction of the electrode and antenna used in the plasma processing apparatus. The present embodiment features that in the embodiment described in connection with any one of FIGS. 1 to 3, a planar member 19 serving as a surface member of the electrode or antenna adjoining plasma is made of Si or SiC, or C. With this construction, the object to be processed can be prevented from suffering from metallic contamination. Further, F generated when a fluorocarbon gas is dissociated can be scavenged by Si or SiC, or C so as to be reduced or controlled in concentration, with the result that the CFx/F ratio can be raised to improve the selectivity for $SiO_2$/Si or $Si_3N_4/SiO_2$.

Figure 5:
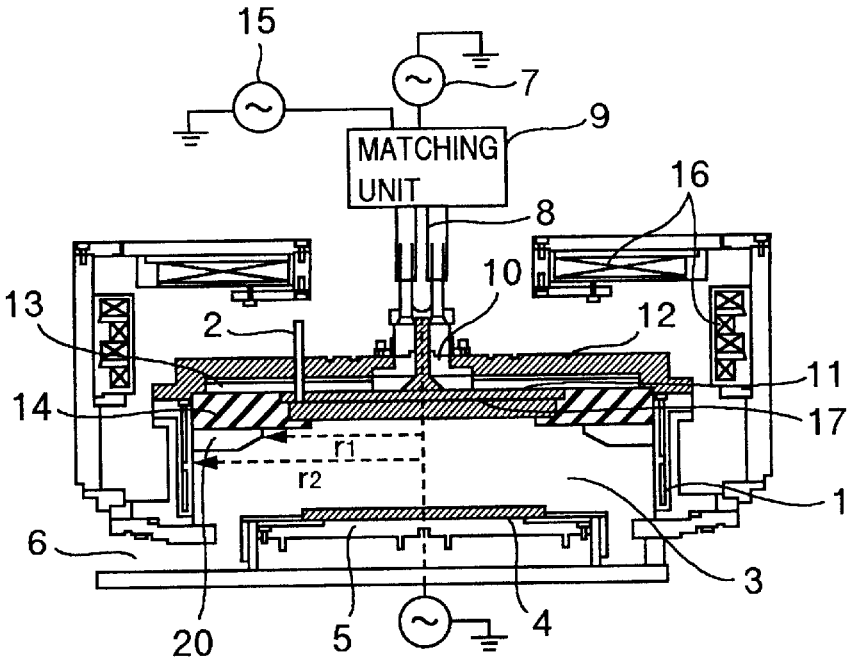
FIG. 5 is a sectional diagram showing a plasma processing apparatus according to a fifth embodiment of the invention.

Referring to FIG. 5, a fifth embodiment of the invention will be described. The present embodiment contemplates the construction of the emitting port used in the plasma processing apparatus. The present embodiment features that in the embodiment described in connection with any one of FIGS. 1 to 3, a second emitting port (dielectric) 20 having a smaller width than the emitting port 14 is arranged on its outer periphery adjoining the processing chamber. When the second emitting port 20 is formed of a ring-shaped dielectric having an inner radius of $r_1$, an outer radius of $r_2$ and a thickness of t, $r_1$ may preferably be larger than the peak position of the peripheral electric field, that is, the aforementioned $r_{peak}$ and $r_2$ may preferably be equal to the chamber radius. The thickness of the ring may be larger than a skin depth 67 $=c/(\omega*\mathrm{Im}\kappa_p^{1/2})$ by which UHF or VHF penetrates into plasma, where ω is angular frequency indicated by $\omega=2\pi f$, c is velocity of light, $\kappa_p$ is dielectric constant of plasma indicated by $\kappa p=1-\omega_{pc}^2/\omega(\omega-j\upsilon^m)$, $\omega_{pc}$ is plasma frequency and $\nu^m$ is electron-neutral particle collision frequency. If the thickness t of the dielectric is larger than δ, the UHF or VHF high frequency is liable to transmit to plasma not through the second emitting port but through the emitting port. For example, in the case of the 150 mm antenna radius described in connection with FIG. 11A, the density at the periphery is excessively high. Then, a planar member, serving as the second emitting port, which is made of quartz having a thickness t=10 mm and a radius $r_1$ of 180 mm is inserted from the outside of the chamber to ensure that the density at the periphery can be lowered to promote uniformity. In addition, since plasma under the second emitting port is weakened, plasma can be increased in density for the same input power as compared to the case where the second emitting port is not provided.

Figure 6:
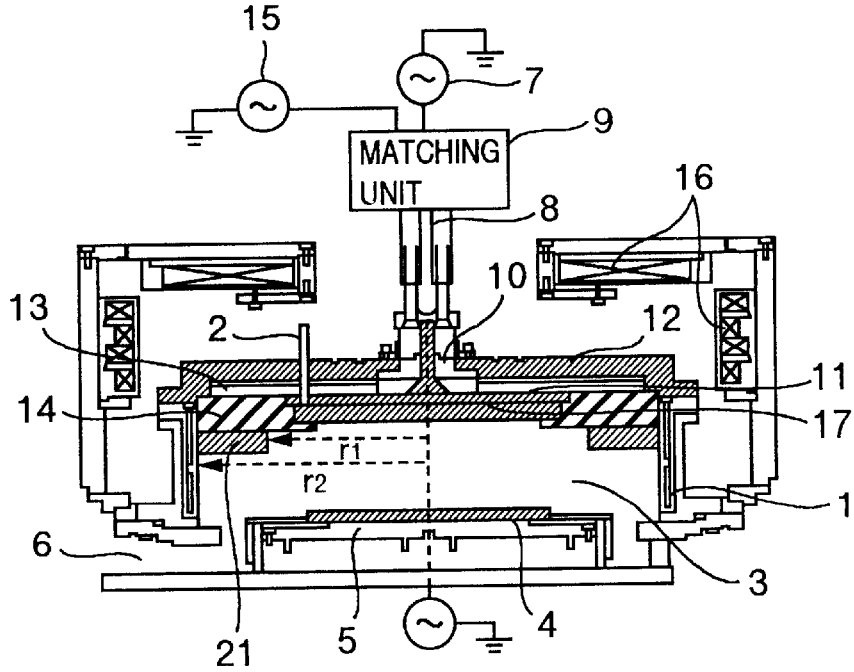
FIG. 6 is a sectional diagram showing a plasma processing apparatus according to a sixth embodiment of the invention.

Referring to FIG. 6, a sixth embodiment of the invention will be described. The present embodiment contemplates the construction of the emitting port used in the plasma processing apparatus. The present embodiment features that in the embodiment described in connection with any one of FIGS. 1 to 3, a metal plate 21 having a smaller width than the emitting port 14 is arranged on the emitting port at its outer periphery adjoining the processing chamber. The metal plate 21 takes the form of a ring having an inner radius $r_1$ and an outer radius $r_2$. The inner radius $r_1$ may be larger than the aforementioned $r_{peak}$ and the outer radius $r_2$ may coincide with the chamber radius. The metal plate 21 can interrupt the VHF and UHF steadily and hence may have an arbitrary thickness. In the case of the 150 mm antenna radius shown in FIG. 11A, the inner radius $r_1$ of the metal plate may be larger than 180 mm. With this construction, surplus plasma generated at the outer periphery can be extinguished, so that the plasma density can be increased while maintaining the uniformity. Preferably, in order to prevent the metal plate from exposing itself to the interior of the processing chamber, the metal plate may be covered with a third dielectric. In this case, the aforementioned relation between the skin depth and the thickness t is applied to the radial thickness of the third dielectric to stipulate that preferably, the thickness be 10 mm or less.

Figure 7B:
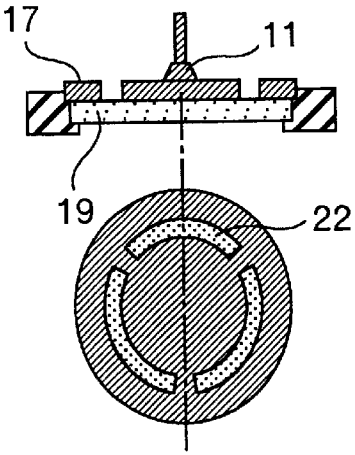
FIGS. 7A, 7B and 7C are diagrams showing a plasma processing apparatus according to a seventh embodiment of the invention.
Figure 7C:
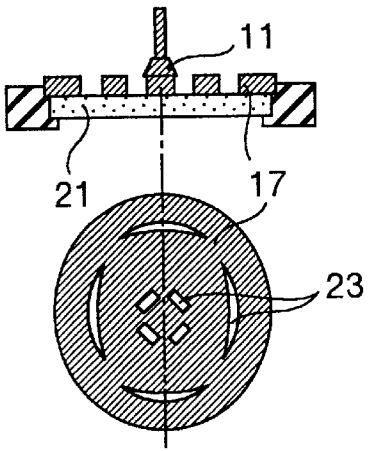
Figure 7A:
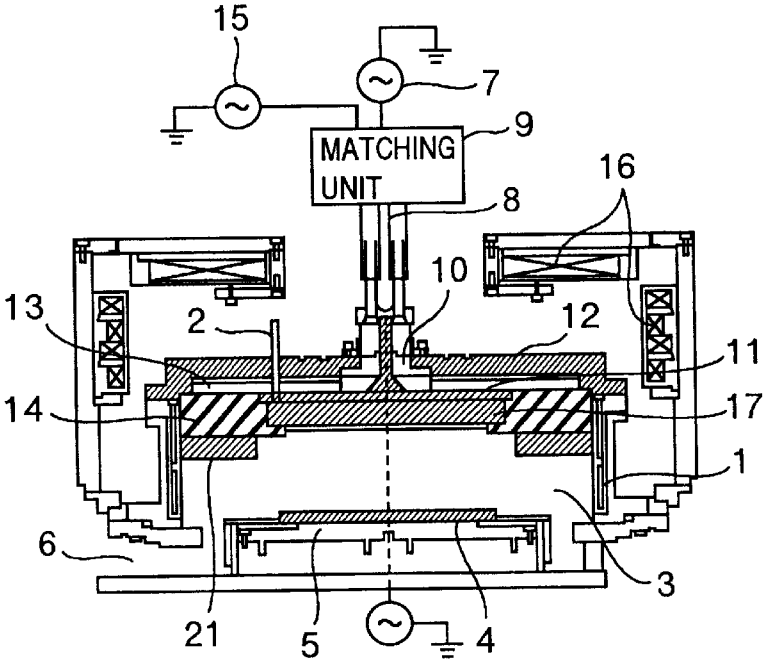

Referring to FIGS. 7A, 7B and 7C, a seventh embodiment of the invention will be described. The present embodiment contemplates the construction of the antenna and emitting port used in the plasma processing apparatus. The present embodiment features that in the embodiment described in connection with FIG. 6, a metal plate 21 having a width smaller than the emitting port 14 is arranged on the emitting port at its outer periphery opposing the processing chamber (FIG. 7A), slit openings 22 are formed in the disk-shaped antenna 17 connected to the electrode 11. The length of the opening is decided about $\lambda/2\pm\lambda/10$, where the wave length in the tube is λ, then the number and the position are determined inversely. For example, in FIG. 7C, four openings are formed for positioning them to the outside. Then for the purpose of emitting the high frequency from the center, the opening is determined to λ/2 in total. And a planar member 19 made of Si or SiC, or C is arranged to oppose the processing chamber 3 as shown in FIG. 7B and the high frequency in UHF or VHF band is supplied to the processing chamber 3 through the planar member 19. The slit opening 22 may be formed at a location where the direction of the high frequency electric field must be changed. The electric field is allowed to have only a component vertical to the antenna and therefore, it has only Ez component when the disk-shaped antenna without slits is used. But with the slits formed, Er component is generated resultingly. Since the external magnetic field B has r component Br and z-direction component Bz, E×B≈0 stands at the slit opening to generate plasma there. In the plasma processing apparatus in FIGS. 7A to 7C, the node of the electric field is positioned at r=110 mm and hence for the purpose of increasing the plasma density at the periphery satisfying r>100 mm, a slit opening having a width of 10 mm may be formed near the node, for example, at a position indicated by r=120 mm. To maintain the axial symmetry, several slits may be opened concentrically and circumferentially. With a view to intensifying the electric field at the slit openings, the length of the slit opening may be integer times ½λ, where λ is the wavelength in waveguide. With a dielectric (having a relative dielectric constant of $\in_r$ ) used as a filler in the slit opening, $\lambda=c/f/(\in_r)^{1/2}$ stands for λ/2≈18 cm stands for quartz having $\in_r$ of 3.5 and frequency of f=450 MHz and accordingly, three slit openings each having a length (arc) of 18 cm may be opened circumferentially at a position satisfying r=120 mm (corresponding to a circumference of 754 mm). Further, with a view to intensifying both the electric fields in the center and at the periphery, a plurality of slit openings may be formed radially and circumferentially as exemplified in FIG. 7C.

In the embodiments of the invention constructed as above, by combining the disk-shaped antenna diameter and the emitting port, 1) the electric field intensity distribution in the radial direction can be changed by the antenna diameter and the emitting port diameter, 2) propagation of the high frequency to the outer periphery can be reduced through the use of high frequency control means provided to the emitting port, and 3) the electric field intensity and its component can be changed by the slits, whereby the control range of plasma distribution can be widened. By using the electric field control means and the magnetic field generating means in combination, the plasma distribution can be controlled in compliance with changes in process parameters such as pressure, the kinds of gas and power.

What is claimed is:

1. A plasma processing apparatus comprising:

a vacuum vessel;

a processing chamber arranged in the vacuum vessel and supplied with gas;

a support electrode arranged in the processing chamber to support an object to be processed;

an antenna having an emitting port, the antenna and the emitting port being adapted to supply a high frequency in a UHF band or a VHF band to the processing chamber; and magnetic field forming means for forming a magnetic field in the processing chamber;

wherein a ratio between a radius of the antenna and an effective length d* of the emitting port is 0.4 or more and 1.5 or less, the effective length d* being defined by $d^*=(f/f_0)d/\in_r^{1/2}$, where f is the high frequency in the UHF band or the VHF band, $f_0$ is a reference frequency of $f_0$=450 MHz, d is a real dimension of the emitting port, and $\in_r$ is a relative dielectric constant of an insulating material constituting the emitting port.

2. A plasma processing apparatus according to claim 1, wherein the antenna has a radius of $\lambda_0/4$, where $\lambda_0$ is a wavelength of the high frequency in a vacuum.

3. A plasma processing apparatus according to claim 1, further comprising a ring-shaped conductor arranged outside the antenna.

4. A plasma processing apparatus according to claim 1, further comprising a planar member made of Si, SiC, or C arranged on a surface of the antenna.

5. A plasma processing apparatus according to claim 1, wherein a second emitting port smaller than the emitting port for the high frequency is arranged on the emitting port for the high frequency at a surface of the emitting port for the high frequency adjoining the processing chamber.

6. A plasma processing apparatus according to claim 1, further comprising a metal plate smaller than the emitting port for the high frequency arranged on the emitting port for the high frequency at a surface of the emitting port for the high frequency adjoining the processing chamber.

7. A plasma processing apparatus according to claim 5, wherein a slit opening is formed in the antenna;

wherein the plasma processing apparatus further comprises a planar member made of Si, SiC, or C arranged on the antenna at a surface of the antenna adjoining the processing chamber; and wherein the high frequency in the UHF band or the VHF band is supplied to the processing chamber through the planar member.

8. A plasma processing apparatus according to claim 6, wherein a slit opening is formed in the antenna;

wherein the plasma processing apparatus further comprises a planar member made of Si, SiC, or C arranged on the antenna at a surface of the antenna adjoining the processing chamber; and wherein the high frequency in the UHF band or the VHF band is supplied to the processing chamber through the planar member.

* * * * *